US008186727B2

(12) United States Patent
Rishel et al.

(10) Patent No.: US 8,186,727 B2
(45) Date of Patent: May 29, 2012

(54) VARIABLE BOLT LENGTH DOOR LATCH

(76) Inventors: James Rishel, Clearfield, PA (US); James Catherman, III, Clearfield, PA (US)

( * ) Notice: Subject to any disclaimer, the term of this patent is extended or adjusted under 35 U.S.C. 154(b) by 384 days.

(21) Appl. No.: 12/431,932

(22) Filed: Apr. 29, 2009

(65) Prior Publication Data

US 2009/0273193 A1 Nov. 5, 2009

Related U.S. Application Data

(60) Provisional application No. 61/126,155, filed on May 1, 2008.

(51) Int. Cl.
*E05C 1/12* (2006.01)

(52) U.S. Cl. ..... 292/69; 292/172; 292/160; 292/142; 292/279

(58) Field of Classification Search ..... 292/112, 292/160, 142, 172, 279
See application file for complete search history.

(56) References Cited

U.S. PATENT DOCUMENTS

| | | | | | |
|---|---|---|---|---|---|
| 2,159,940 | A | * | 5/1939 | Endter | 292/192 |
| 2,253,257 | A | * | 8/1941 | Wellman | 292/172 |
| 2,290,727 | A | * | 7/1942 | Best | 292/172 |
| 2,290,728 | A | * | 7/1942 | Best | 292/172 |
| 2,614,876 | A | * | 10/1952 | McConnell | 292/172 |
| 2,636,376 | A | * | 4/1953 | McConnell | 70/151 R |
| 3,264,025 | A | * | 8/1966 | Hawes | 292/166 |
| 4,058,333 | A | * | 11/1977 | Roe et al. | 292/172 |
| 4,255,953 | A | | 3/1981 | Dietrich et al. | |
| 4,333,324 | A | | 6/1982 | Dietrich et al. | |
| 4,502,716 | A | * | 3/1985 | Tsai | 292/142 |
| 4,687,239 | A | * | 8/1987 | Lin | 292/172 |
| 4,887,442 | A | * | 12/1989 | Lavelle | 70/143 |
| 4,890,871 | A | * | 1/1990 | Lin | 292/337 |
| 4,945,737 | A | * | 8/1990 | Hart | 70/143 |
| RE34,240 | E | * | 5/1993 | Lin | 292/337 |
| 5,647,617 | A | * | 7/1997 | Kajuch | 292/1.5 |
| 6,007,115 | A | | 12/1999 | Roth | |
| 6,045,169 | A | | 4/2000 | Frolov | |
| 6,557,909 | B2 | | 5/2003 | Morris | |
| 7,731,250 | B2 | * | 6/2010 | Garneau et al. | 292/144 |
| 2008/0307837 | A1 | * | 12/2008 | Greiner et al. | 70/282 |

* cited by examiner

*Primary Examiner* — Thomas A Beach
*Assistant Examiner* — Sajid R Ansari
(74) *Attorney, Agent, or Firm* — James Ray & Assoc

(57) ABSTRACT

The present invention is a door lock that eliminates the need for an additional deadbolt lock on a door. The present invention has a deadbolt built into the doorknob assembly. The deadbolt is put into place every time the door is closed. This eliminates the need of having to separately lock and unlock two locks, the first being the doorknob and the second being the deadbolt.

15 Claims, 4 Drawing Sheets

VARIABLE BOLT LENGTH DOOR LATCH

CROSS REFERENCE TO RELATED APPLICATION

This patent application is related to and claims priority from U.S. Provisional Patent Application Ser. No. 61/126,155 filed May 1, 2008.

FIELD OF THE INVENTION

This invention generally pertains to door latches. More specifically, the present invention relates to a door latch capable of varying its bolt length for improved security and ease of installation.

BACKGROUND OF THE INVENTION

The invention is particularly applicable to door latches and will be described with particular reference thereto. However, it will be appreciated by those skilled in the art that the invention has broader applications and may also be adapted for use in latches for containers, safes and the like.

The installation of a doorknob and deadbolt combination can often be difficult and laborious. An individual may want multiple doors in their home to have deadbolts but can not afford to have each door drilled and a deadbolt combination put into place. Some doors may be made of steel or other difficult to drill materials and may require special tools to drill.

Accordingly, it has been considered desirable to develop a new and improved door latch which would overcome the foregoing difficulties and others while providing better and more advantageous overall results

SUMMARY OF THE INVENTION

The present invention is a device that eliminates the need for an additional deadbolt lock on a door. The present invention has a deadbolt built into the doorknob assembly. The deadbolt is put into place every time the door is closed. This eliminates the need of having to separately lock and unlock two locks, the first being the doorknob and the second being the deadbolt.

The operation of the lock from a user's perspective would be like operating a standard locking door knob. The difference is within the latch, where there is a variable bolt length assembly. When the door is pulled shut the dead bolt collapses and then moves into place within the door jam. The deadbolt may protrude approximately 1 inch every time the door is shut. An approximately 1 inch protrusion would enable the lock to be classified as grade one (ANSI designation), although when the deadbolt feature is not in use, it will appear as traditional grade. Traditional grade is considered to be approximately 0.5 inches in length.

The present invention could be constructed of the same or similar materials as traditional locks. Preferably, the invention is constructed of metal or metal alloy. For example the present invention could be constructed of steel, copper, brass, aluminum, titanium or the like. The material chosen will largely depend on cost considerations and the level of strength desired.

OBJECTS OF THE INVENTION

It is therefore one of the primary objects of the present invention to provide a locking door knob with a bolt that can protrude from a door at variable lengths by means of a variable bolt length assembly.

Another object of the present invention is to provide a locking door knob with a variable bolt length assembly that is capable of fitting in a standard door knob hole.

Still another object of the present invention is to provide a variable bolt length assembly that is adaptable for use in most standard doorknob assemblies.

In one embodiment the invention is a door lock comprising: a bolt, a rotator gear, a bushing, a compression spring, a T-coupler, wherein the bolt comprises bolt gearing for engaging said rotator gear to extend said bolt. In another embodiment the door lock is constructed substantially of steel. In yet another embodiment wherein the door lock is constructed substantially of aluminum. In still another embodiment the door lock is constructed substantially of powder pressed metal. In yet still another embodiment the door lock is constructed of material produced by powder metallurgy methods.

In a further embodiment the invention is a door lock comprising: a bolt, a rotator gear, a bushing, a compression spring, a T-coupler, a lock tube, wherein said bolt, said rotator gear, said bushing, said compression spring, and said T-coupler are assembled together inside said lock tube to form a variable bolt length assembly. In another embodiment the bolt is lockable at a first position, a second position, or a third fully retracted position. In yet another embodiment the door lock is constructed substantially of steel. In still yet another embodiment the door lock is constructed substantially of aluminum. In still another embodiment the door lock is constructed substantially of powder pressed metal. In yet another embodiment the door lock is constructed of material produced by powder metallurgy methods.

In a further embodiment the invention is a door lock comprising: a bolt, a rotator gear, a bushing, a compression spring, a T-coupler, a lock tube, wherein said bolt, said rotator gear, said bushing, said compression spring, and said T-coupler are assembled together inside said lock tube to form a variable bolt length assembly, wherein said bolt is lockable at a first position, and a second position. In another embodiment the door lock is constructed substantially of steel. In yet another embodiment the door lock is constructed substantially of aluminum. In still another embodiment wherein the door lock is constructed substantially of powder pressed metal. In still yet another embodiment the door lock is constructed of material produced by powder metallurgy methods.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention; and together with the description serve to explain the principles and operation of the invention.

Figure 1:
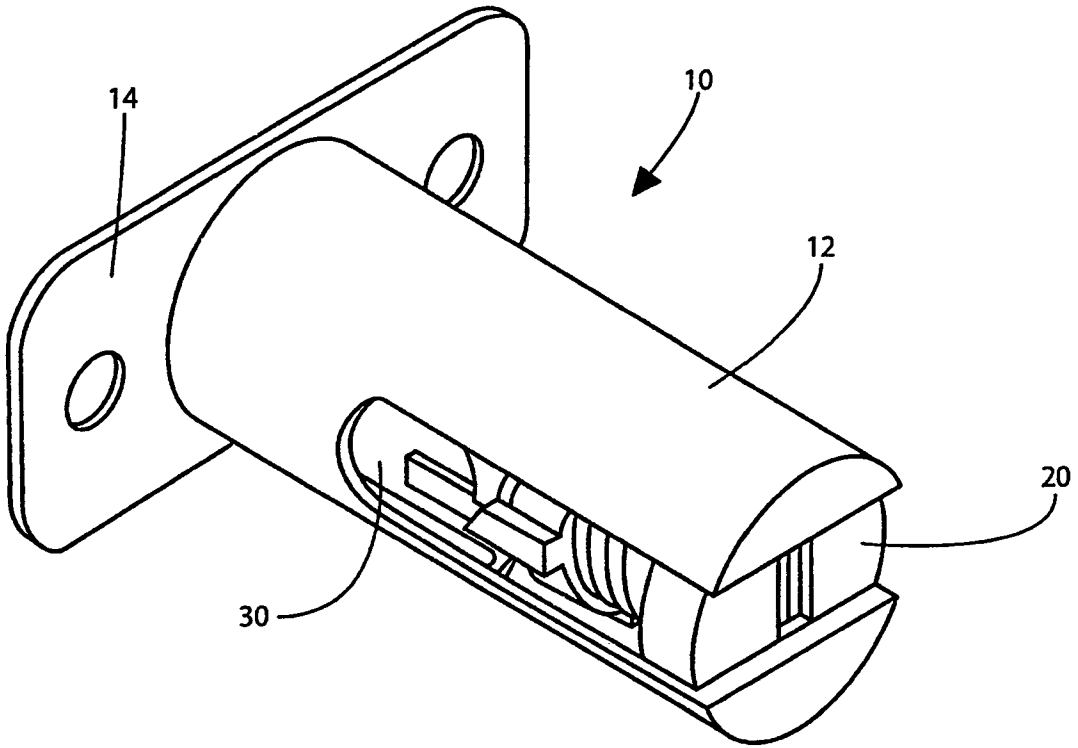
FIG. 1 is a general perspective view of one embodiment of the present invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIG. 1 which is a general perspective drawing of a lock tube containing a variable bolt length assembly. Lock tube 10 comprises a cylindrical shaft 12 housing the variable bolt length assembly, and an attachment plate 14. Lock tube 10 also has alignment grooves (not shown) that in conjunction with corresponding alignment grooves on bolt 30 keep bolt 30 in proper alignment. Preferably, lock tube 10 is formed as one continuous piece of material, but could be formed as two or more pieces fused or welded together. Also, shown is T-coupler 20 which serves as a universal attachment point for a driving mechanism of a door knob set.

Figure 2:
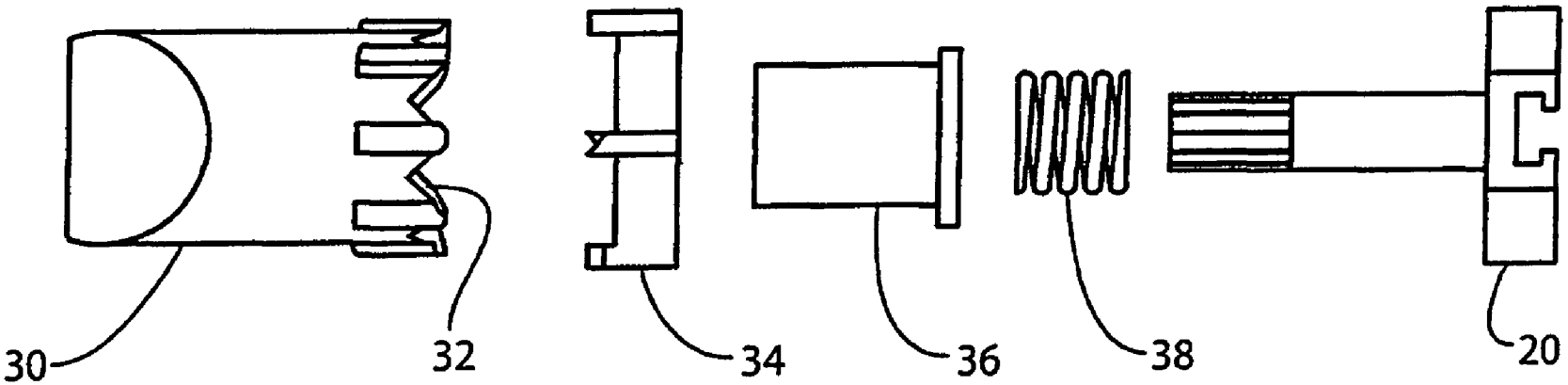
FIG. 2 is an exploded view of the variable bolt length assembly of one embodiment of the present invention.

Reference is now made, more particularly, to FIG. 2 which is an exploded view of the variable bolt length assembly of one embodiment of the present invention. Bolt 30 with bolt gearing 32 is mechanically engaged to rotator gear 34. The shaft of T-coupler 20 is inserted into interior of compression spring 38, bushing 36, rotator gear 34 and bolt 30. When T-coupler 20 is attached to a driving mechanism, the variable bolt length assembly will collapse on every other cycle function. The compression spring 38 will engage the rotator gear 34. The rotator gear 34 will align in separate tracks located in the lock tube to set a half inch latch point or a one inch deadbolt. The bolt gearing 32 and the rotator gear 34 are such that they operate in continuous misalignment to force the rotator gear 34 to make a revolution from a half inch latch to a one inch latch on every other cycle function of the handle set. For the purposes here, a cycle function should be understood as manipulating a door knob a full operational turn. The exact definition of a full turn will vary with the exact geometries of the handle set being used, but a 90 degree turn of a door knob is typical of many door knob sets.

Figure 3:
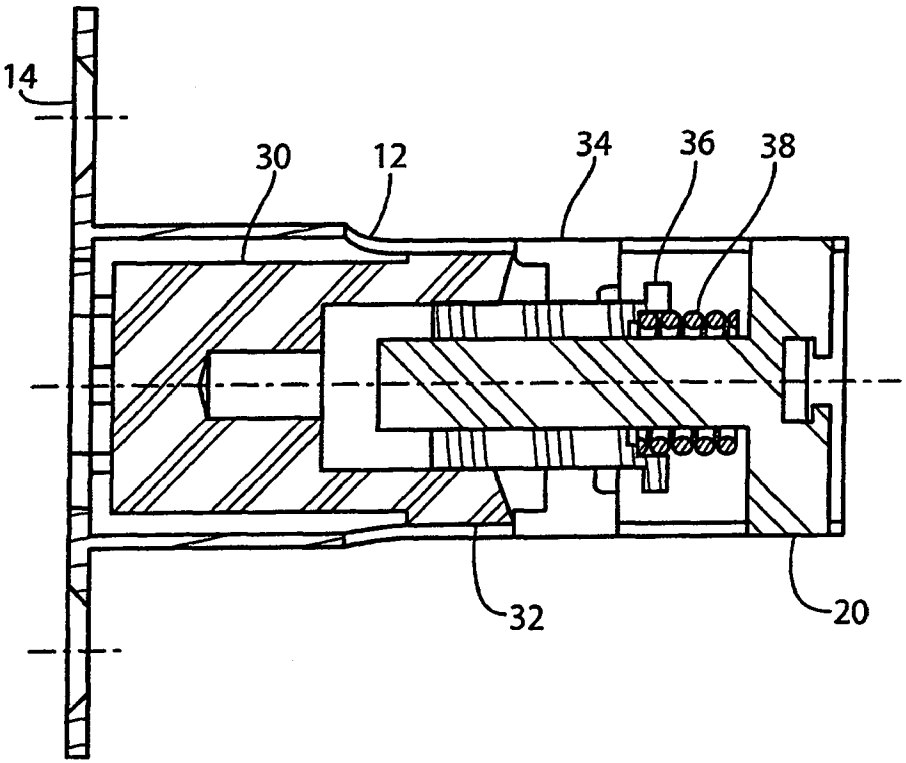
FIG. 3 is a cutaway view of the variable bolt length assembly of one embodiment of the present invention.

Reference is now made, more particularly, to FIG. 3 a cutaway view of the variable bolt length assembly of one embodiment of the present invention. Bolt 30 with bolt gearing 32 is mechanically engaged to rotator gear 34. The shaft of T-coupler 20 is inserted into interior of compression spring 38, bushing 36, rotator gear 34 and bolt 30. When T-coupler 20 is attached to a driving mechanism, the variable bolt length assembly will collapse on every other cycle function. The compression spring 38 will engage the rotator gear 34. The rotator gear 34 will align in separate tracks located in the lock tube to set a half inch latch point or a one inch deadbolt. The bolt gearing 32 and the rotator gear 34 are such that they operate in continuous misalignment to force the rotator gear 34 to make a revolution from a half inch latch to a one inch latch on every other turn of the handle set.

Figure 4:
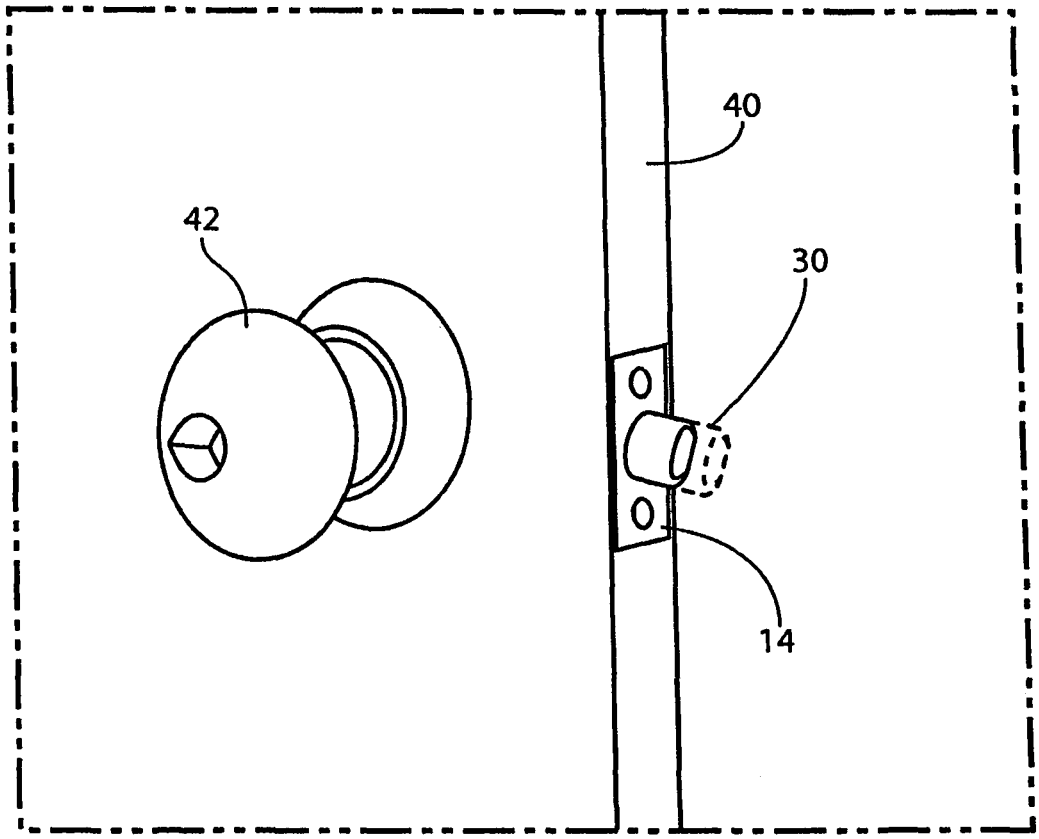
FIG. 4 is a general perspective view of one embodiment of the present invention installed in a door with a door knob set.

Reference is now made, more particularly, to FIG. 4 a general perspective view of one embodiment of the present invention. Door 40 is shown with attachment plate 14 attached to door 40. Bolt 30 is shown in solid lines in a half inch position and shown in dashed lines is a one inch position. Door knob 42 is an interactive part of the handle set. Bolt 30 makes a revolution from a half inch latch to a one inch latch on every other turn of the door knob 42. Also, when bolt 30 is in the half inch latch position and the door 40 is closed, bolt 30 is pushed into door 40 by door strike plate (not shown). This action causes the variable bolt assembly to cycle function, so that when door 40 is closed bolt 30 makes a revolution from a half inch latch to a one inch latch position.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

What is claimed:

1. A door lock comprising:

a bolt having a first plurality of teeth disposed on an exterior surface of said bolt at end thereof being opposite to an end of said bolt engaging a door jamb along a longitudinal axis of said door lock, a rotator gear having a center aperture formed through a thickness thereof and a second plurality of teeth disposed on an exterior surface of said rotator gear and operatively meshing with said first plurality of teeth so that said bolt moves reciprocally between a partially extended position and a fully extended position during rotation of said rotator gear, a bushing having an axial cavity, a peripheral flange disposed at one end of said bushing and extending outwardly from an exterior surface thereof, said exterior surface of said bushing sized so as to be received within said central aperture of said rotator gear, and an axial bore disposed in said one end of said bushing, a compression spring having one end thereof seated in said axial bore, and a T-coupler having a portion thereof disposed normal to said longitudinal axis, and a T-shaped slot disposed in an exterior surface of said portion.

2. The door lock of claim 1, wherein the door lock is constructed substantially of steel.

3. The door lock of claim 1, wherein the door lock is constructed substantially of aluminum.

4. The door lock of claim 1, wherein the door lock is constructed substantially of powder pressed metal.

5. The door lock of claim 1, wherein the door lock is constructed of material produced by powder metallurgy methods.

6. A door lock comprising:

a bolt having a first plurality of teeth disposed on an exterior surface of said bolt at end thereof being opposite to an end of said bolt engaging a door jamb along a longitudinal axis of said door lock, a rotator gear having a center aperture formed through a thickness thereof and a second plurality of teeth disposed on an exterior surface of said rotator gear and operatively meshing with said first plurality of teeth so that said bolt moves reciprocally between a partially extended position and a fully extended position during rotation of said rotator gear, a bushing having an axial cavity, a peripheral flange disposed at one end of said bushing and extending outwardly from an exterior surface thereof, said exterior surface of said bushing sized so as to be received within said central aperture of said rotator gear, and an axial bore disposed in said one end of said bushing, a compression spring having one end thereof seated in said axial bore, a T-coupler having a first portion thereof extending along said longitudinal axis and being passed through an interior of said spring into said axial cavity of said bushing, a second portion disposed normal to said first portion, and a T-shaped slot disposed in an exterior surface of said second portion, wherein an opposite end of said spring is disposed adjacent an interior surface of said second portion, a lock tube, and wherein said bolt, said rotator gear, said bushing, said compression spring, and said T-coupler are assembled together inside said lock tube.

7. The door lock of claim 6, wherein the door lock is constructed substantially of steel.

8. The door lock of claim 6, wherein the door lock is constructed substantially of aluminum.

9. The door lock of claim 6, wherein the door lock is constructed substantially of powder pressed metal.

10. The door lock of claim 6, wherein the door lock is constructed of material produced by powder metallurgy methods.

11. A door lock comprising:

a bolt having a first plurality of teeth disposed on an exterior surface of said bolt at end thereof being axially opposite to the end engaging a door jamb, a rotator gear having a center aperture formed through a thickness thereof and a second plurality of teeth disposed on an exterior surface of said rotator gear and operatively meshing with said first plurality of teeth so that said bolt moves reciprocally between a partially extended position and a fully extended position during rotation of said rotator gear, a bushing having an axial cavity, a peripheral flange disposed at one end of said bushing and extending outwardly from an exterior surface thereof, said exterior surface of said bushing sized so as to be received within said central aperture of said rotator gear, and an axial bore disposed in said one end of said bushing, a compression spring having one end thereof seated in said axial bore, a T-coupler having a first portion thereof being passed through an interior of said spring into said axial cavity of said bushing, a second portion disposed normal to said first portion, and a T-shaped slot disposed in an exterior surface of said second portion, a lock tube having a pair of longitudinal slots formed through a wall thereof, and wherein said bolt, said rotator gear, said bushing, said compression spring, and said T-coupler are assembled together inside said lock tube.

12. The door lock of claim 11, wherein the door lock is constructed substantially of steel.

13. The door lock of claim 11, wherein the door lock is constructed substantially of aluminum.

14. The door lock of claim 11, wherein the door lock is constructed substantially of powder pressed metal.

15. The door lock of claim 11, wherein the door lock is constructed of material produced by powder metallurgy methods.

* * * * *